United States Patent [19]

Totten

[11] Patent Number: 4,635,662

[45] Date of Patent: Jan. 13, 1987

[54] INLINE BOTTLE RINSER WITH QUICK BOTTLE SIZE CHANGEOVER CAPABILITY

[75] Inventor: Roger W. Totten, Ventura, Calif.

[73] Assignee: Industrial Automation Corporation, Goleta, Calif.

[21] Appl. No.: 700,408

[22] Filed: Feb. 11, 1985

Related U.S. Application Data

[63] Continuation of Ser. No. 445,283, Nov. 29, 1982, abandoned.

[51] Int. Cl.[4] ..... B08B 9/00

[52] U.S. Cl. ..... 134/68; 134/131; 134/152; 134/181; 198/339.1; 198/345

[58] Field of Search ..... 134/42, 62, 65, 66, 134/67, 68, 126, 131, 151, 152, 153, 167 R, 170, 180, 181; 198/339.1, 345, 576

[56] References Cited

U.S. PATENT DOCUMENTS

| | | | |
|---|---|---|---|
| 2,634,737 | 4/1953 | Rowe | 134/152 X |
| 2,696,823 | 12/1954 | Scott | 134/122 R |
| 3,563,256 | 2/1971 | Babunovic | 134/181 |
| 4,102,351 | 7/1978 | Wiendahl et al. | 134/129 |
| 4,104,081 | 8/1978 | Totten | 134/152 X |
| 4,427,020 | 1/1984 | Riederer | 134/127 |

*Primary Examiner*—Harvey C. Hornsby
*Assistant Examiner*—Frankie L. Stinson
*Attorney, Agent, or Firm*—Blakely, Sokoloff, Taylor & Zafman

[57] ABSTRACT

An inline bottle rinser having quick bottle size changeover capabilities is disclosed. The bottle rinser has a linear bottle path therethrough with spray heads synchronized to the bottles for accurately directing rinse water through the open neck of the inverted bottles. The bottle carriers are mounted so as to be automatically snapped off the transport system so that bottle carriers for other size bottles may be snapped onto the transport system for changeover purposes. The rinser includes a rinse water spray system which may be raised and lowered in accordance with the bottle size in such a manner as to assure proper synchronization of the rinse water spray system for various bottle sizes. For particularly large containers, that smaller bottle carriers may be automatically removed and half that number of larger bottle carriers mounted on the transport system. Provisions are included for quick change of the spray head assembly, and for quick change of the bottle feed-in and feed-out worms and change of worm drive speed as required.

19 Claims, 13 Drawing Figures

INLINE BOTTLE RINSER WITH QUICK BOTTLE SIZE CHANGEOVER CAPABILITY

This is a continuation of application Ser. No. 445,283 filed Nov. 29, 1982, now abandoned.

BACKGROUND OF THE INVENTION

1. Field of the Invention.

The present invention relates to bottle rinsers.

2. Prior Art.

Various types of bottle rinsers are well known in the prior art. In general, the function of such devices is to receive bottles, preferably in the upright position, turn the bottles over, spray water over the outside of the bottle and particularly upward into the open neck of the bottle to flush the entire bottle of any foreign matter which inadvertently previously found its way into the bottle, to drain the bottle and then reinvert the bottle to the upright position again. Such equipment is most generally used with glass bottles, though it is to be noted that the word "bottle" as used herein is not to be so limited, but rather the word "bottle" is used in the most general sense to include other types of containers such as by way of example, plastic bottles now also commonly used for the packaging of food and beverage products.

U.S. Pat. No. 4,104,081 discloses an inline bottle rinser having many features and advantages over other prior art bottle rinsers. By way of example, most prior art bottle rinsers somehow moved inverted bottles over stationary, upward directed spray heads, with the net result that only a small percentage of the upward directed spray actually proceeded into the bottle to rinse the inner portion thereof. While such equipment generally functions satisfactorily, it makes inefficient use of what must be particularly clean and clear water, an increasingly expensive commodity. Also many types of prior art rinsers invert the bottle for rinsing through a transport system which proceeds around a sprocket, with the net result that the direction of movement of the bottles reverses during rinsing. Here again while such equipment conceptually is satisfactory, the resulting equipment configuration is less than ideal and the resulting configuration frequently does not integrate well into conventional bottling plant layouts. Finally, one type of prior art bottle rinser guides a continuous stream of bottles through a first twisting section to invert the bottles for rinsing and then through a second twisting section to reinvert the bottles, the bottles being propelled by a driving force thereon at the infeed end of the guides. Such a system works with glass bottles, though obviously encourages some abrasion between bottles because of the driving force. However, such a system encounters great difficulty with the thin plastic bottles currently being used particularly in the soft drink industry, as the rotation of the bottles, one with respect to another, in the twisting regions inverting and reinverting the bottles, puts the bottles in a sidewall to sidewall contact position. In this position, the sidewalls tend to temporarily collapse so that the center lines of the bottles in the twisted regions move closer together than can be allowed in the subsequent straight guide section, frequently resulting in a jam in the system.

In U.S. Pat. No. 4,104,081, an inline bottle rinser is disclosed which overcomes many of the foregoing problems. In that bottle rinser, a substantially linear transport system is provided with individual bottle carriers thereon, each pivotally supported on the transport system about an axis parallel to the direction of motion of the transport system. The rinser includes an infeed worm system to receive bottles from an infeed conveyor and load them individually in the carriers. Thereafter the bottles are each supported and transported by the carriers, the carriers themselves and thus the bottles therein being rotated 180 degrees to invert the bottles prior to passage into the rinse section and to thereafter rotate the carriers and thus the bottles back to the original position. Because of the carrier arrangement the rinser would also be usable with the thin walled plastic bottles hereinbefore referred to. In addition, the rinser features rotating spray head assemblies so that the spray is purposely directed up the neck of the open bottle through a changing angle so as to positively rinse the bottles with minimum use of water. The system of that patent however, is configured for a specific size bottle and does not include any changeover capability to allow a rinser set up for one size bottle to be converted to handle a second size bottle. Accordingly, it is a purpose of the present invention to maintain the advantageous characteristics of the inline bottle rinser of U.S. Pat. No. 4,104,081, but to do so in a manner which will allow a quick changeover capability whereby a rinser of one basic configuration can be manufactured and sold for use by different bottlers using different size bottles, and a rinser configured to handle bottles of one size may be readily changed over to bottles of substantially any other size.

BRIEF SUMMARY OF THE INVENTION

An inline bottle rinser having quick bottle size changeover capabilities is disclosed. The bottle rinser has a linear bottle path therethrough with spray heads synchronized to the bottles for accurately directing rinse water through the open neck of the inverted bottles. The bottle carriers are mounted so as to be automatically snapped off the transport system so that bottle carriers for other size bottles may be snapped onto the transport system for changeover purposes. The rinser includes a rinse water spray system which may be raised and lowered in accordance with the bottle size in such a manner as to assure proper synchronization of the rinse water spray system for various bottle sizes. For particularly large containers, that smaller bottle carriers may be automatically removed and half that number of larger bottle carriers mounted on the transport system. Provisions are included for quick change of the spray head assembly, and for quick change of the bottle feed-in and feed-out worms and change of worm drive speed as required.

DETAILED DESCRIPTION OF THE INVENTION

Figure 1:
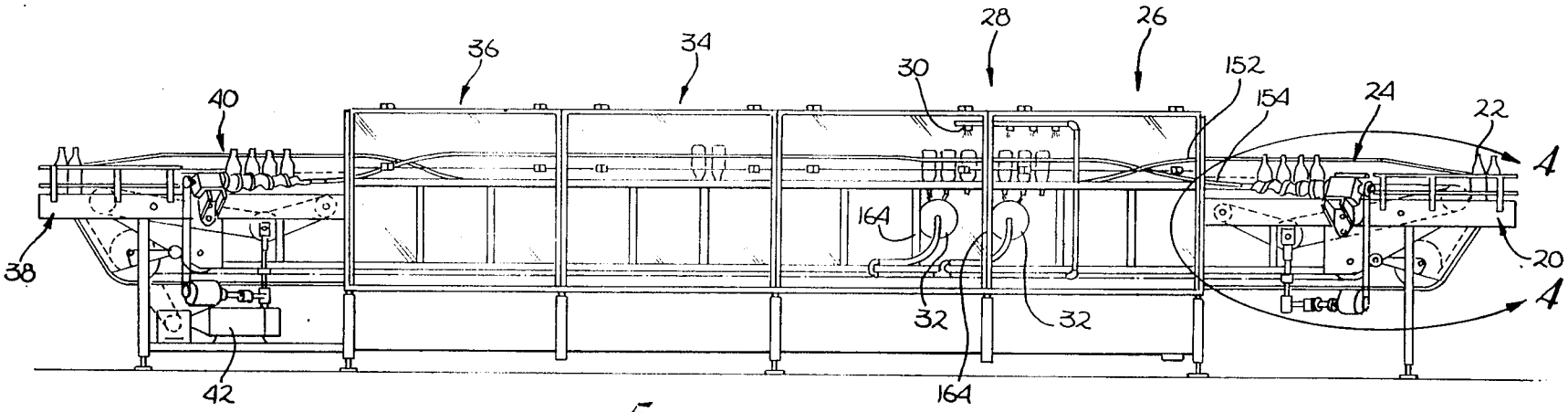
FIG. 1 is a side view illustrating a rinser incorporating the present invention.
Figure 4:
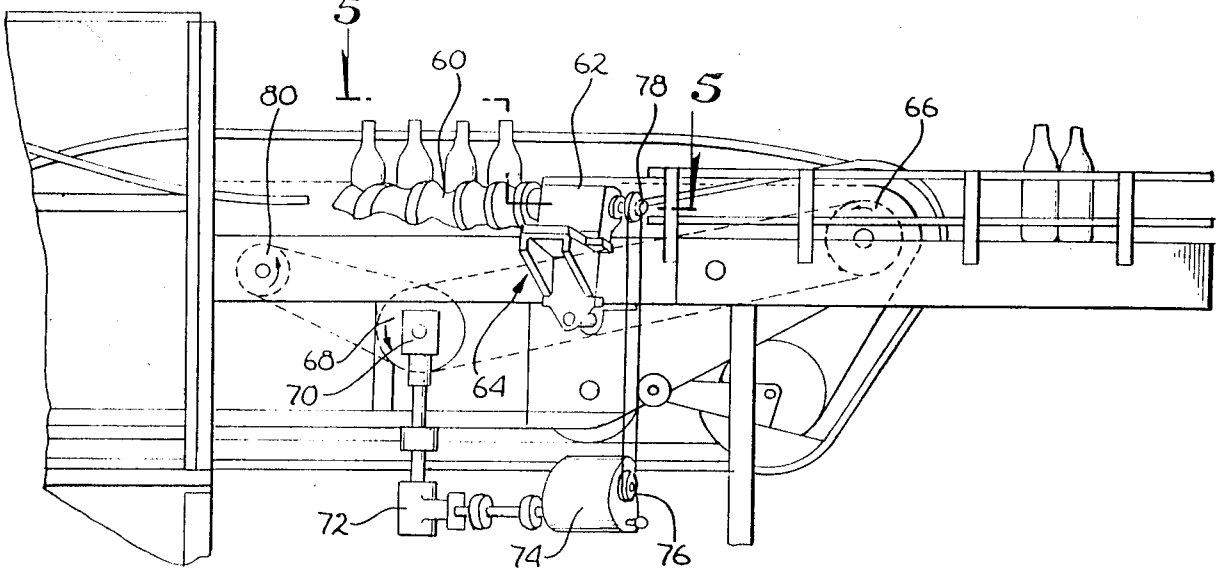
FIG. 4 is a side view of the infeed portion of the rinser taken along 4—4 of FIG. 1.

First referring to FIG. 1, a side view of the rinser of the present invention may be seen. The rinser includes an infeed conveyor assembly, generally indicated by the numeral 20, which receives bottles 22 in a single file back to back manner (not all bottles being shown in FIG. 1 for purposes of clarity) and delivers those bottles to an angularly disposed infeed worm assembly, generally indicated by the numeral 24, which deposits the bottles into individual carriers on the transport system. Once the bottles are positioned in the carriers, the carriers are inverted generally in region 26 of the transport system, so that the bottles are in the inverted position when preceeding through the rinse station 28 where overhead spray nozzles 30 rinse the outside of the bottles and rotating spray head assemblies 32 direct water upward through a constantly changing angle to rinse the inside of the bottle. The bottles then proceed through a draining region 34, to be rotated again to the upright position in region 36 of the rinser for stripping from the individual carriers and delivery to an outfeed conveyor system 38 by an outfeed worm assembly 40, substantially similar to the infeed worm assembly 24. The entire transport system, including the infeed and outfeed conveyors, is driven by a motor drive 42, the motor being controlled in average speed so as to keep bottles in the outfeed system to adequately supply bottles to the downstream equipment without clogging the outfeed system or emptying the infeed system of bottles. These general features of the rinser are in accordance with the patent hereinbefore referred to, and will only be further described herein as required for the present invention.

Figure 2:
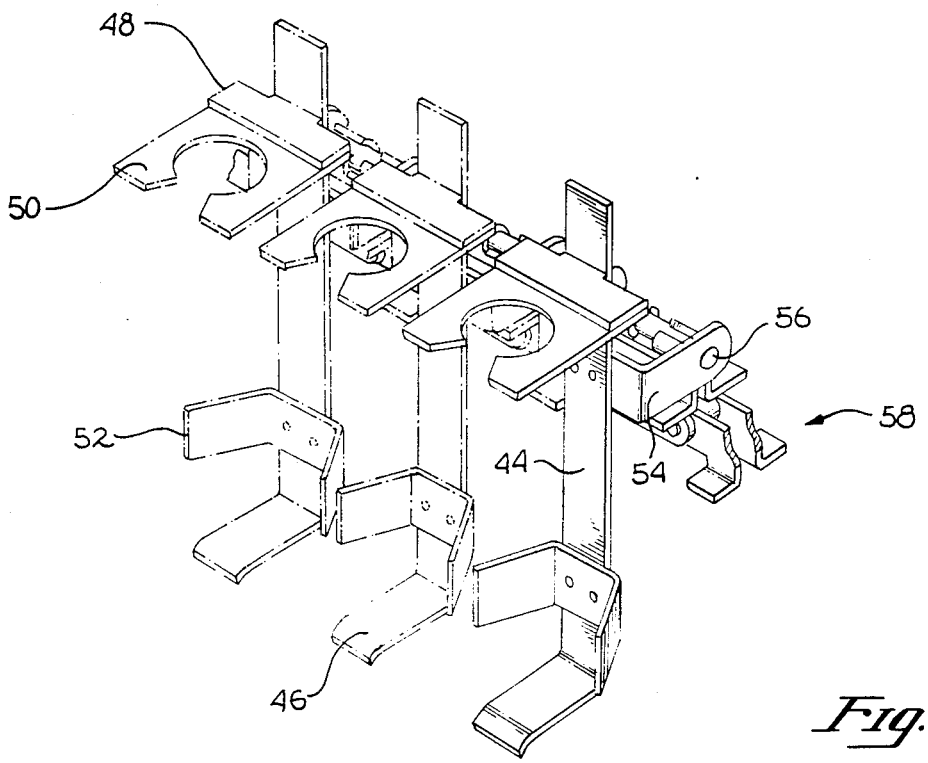
FIGS. 2 and 3 illustrate different size carriers and the mounting thereof for the present invention.
Figure 3:
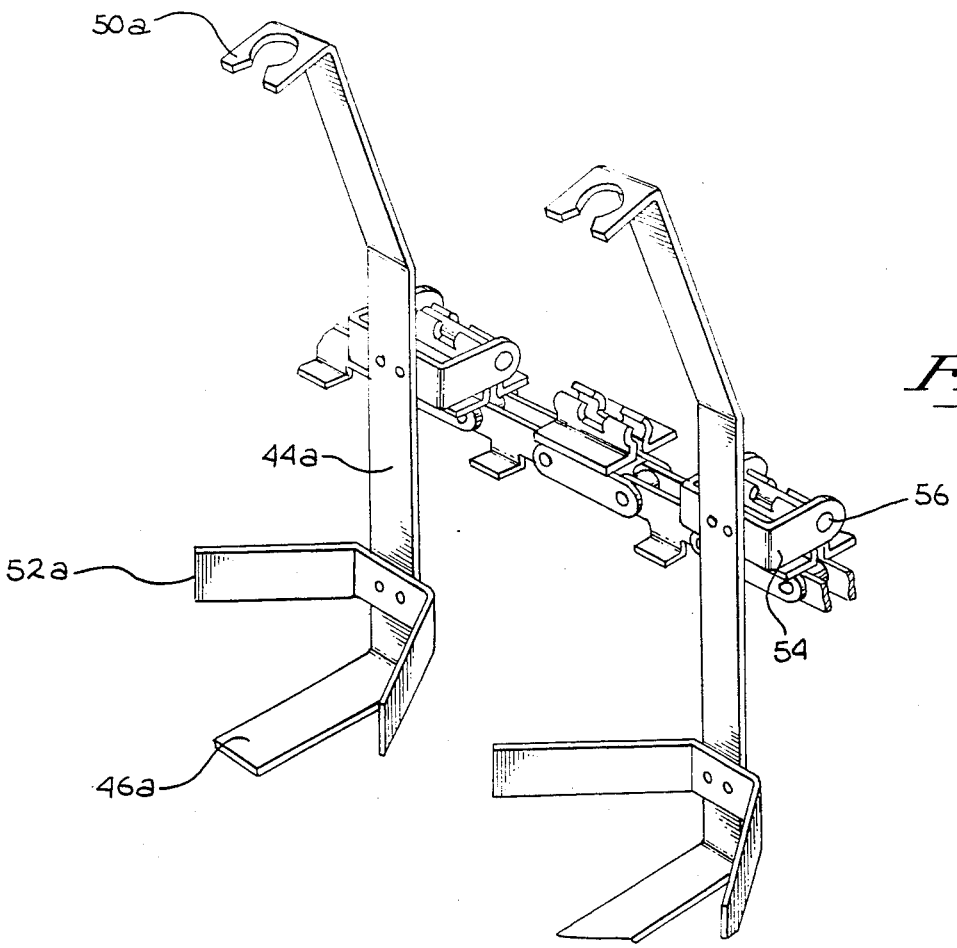
Figure 5:
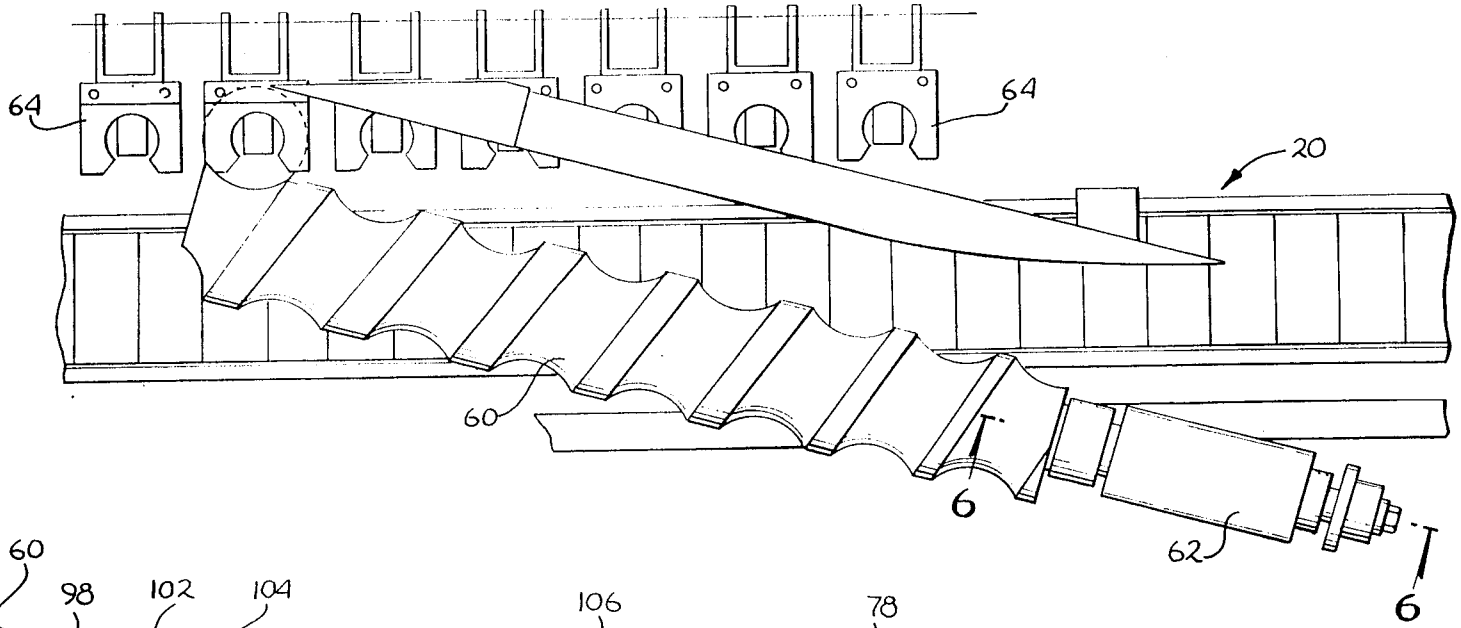
FIG. 5 is a top view of the infeed worm and associated mechanism of the rinser of FIG. 1.
Figure 6:
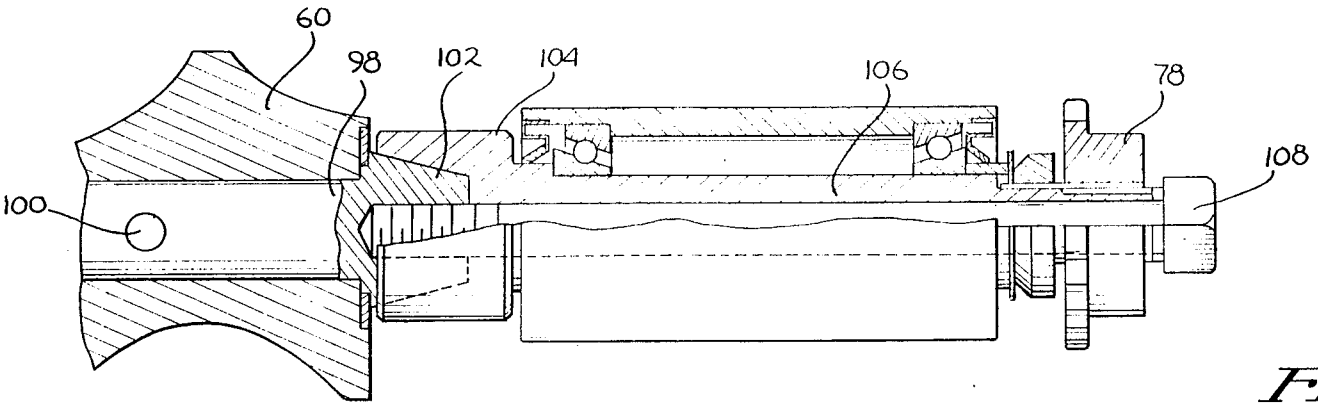
FIG. 6 is a cross section taken along line 6—6 of FIG. 5.

Now referring to FIGS. 2 and 3, typical carriers forming part of the present invention may be seen. The carrier of FIG. 2 is generally comprised of a vertically oriented (using the orientation shown in the figure) member bent at the bottle to form a bottle bottom supporting platform-like horizontal extension 46. Adjacent the top of member 44 is a support member 48 supporting a flexible plastic member 50 configured and proportioned to yieldably receive and retain the neck portion of a bottle of corresponding size. A side support member 52 is riveted to member 44, projecting outward at a slight angle to engage and guide the sides of a bottle urged thereinto by the infeed worm assembly 24 (FIG. 1). Finally, the entire bottle carrier is supported by a "U" shaped support member 54, riveted to member 44, the support member 54 having a pin 56 therein to be pivotally supported on the main transport chain assembly, generally indicated by the numeral 58.

The carrier shown in FIG. 2 is shown as being mounted on each mounting link of the main transport chain. Such a carrier in the preferred embodiment of the invention may be proportioned to receive and support bottles having a diameter of up to $2\frac{7}{8}$ inches. In particular, the main transport chain in the preferred embodiment of the invention utilizes a chain having a chain pin spacing of $1\frac{1}{2}$ inches, with alternate links serving as guide links and carrier support links respectively. Thus, since care is taken to guide the chain so that it will never assume a concave contour, and to orient the carriers so as to not have any radially inward projecting portions when the chain bends in the intended direction around the sprocket, carriers handling bottles having a diameter approaching 3 inches can safely be used on every carrier supporting link.

For larger bottles, carriers like that shown in FIG. 3 are used. The carrier of that figure is generally similar in construction to the carrier of FIG. 2, though proportioned somewhat differently to accommodate a larger bottle. Thus in FIG. 3, parts of the carrier having the same general function, though different proportions from the equivalent parts of FIG. 2, are identified with the same numeral as in FIG. 2 followed with an "a".

Certain important aspects of the present invention may be explained with respect to FIGS. 2 and 3 as well as reference to FIG. 1. In particular, the infeed conveyor structure is fastened to or comprises part of the structure of the rinser itself, so that the elevation of the infeed conveyor is fixed with respect to the elevation of the transport system through the rinser. Of course the outfeed conveyor is also fixed with the same relative elevation. This is preferred, as it allows fixing of the infeed and outfeed conveyors with respect to adjacent equipment in spite of any changeover from one bottle size to another. The net result of this constraint however, is that the bottle bottom supporting member 46 of any carrier for any size bottle will have the same relative elevational spacing with respect to the pivot pin 56 for the carrier (FIG. 2). This is true not only for the various sizes of smaller carriers mounted on every carrier mounting block as shown in FIG. 2, but also carries over to the larger carriers mounted on every other carrier block, as shown in FIG. 3. Thus, as it may be seen by comparing FIGS. 2 and FIG. 3, the spacing between pivot pin 56 and the bottle bottom supporting member 46 of FIG. 2 is the same as the spacing between pivot pin 56 and the bottle bottom supporting member 46*a* of FIG. 3. Obviously therefore, the vertical spacing between the pivot pin axis and the bottle top will vary greatly, depending on bottle height.

In addition to the foregoing, it will be noted by comparing FIGS. 2 and 3 that, using the carrier orientations of those figures, the horizontal spacing between the axis of pivot pin 56 and the center line of the bottle pocket in the carrier the effective center line of a bottle mounted in the carrier) for the smaller carriers of FIG. 2 is less than the equivalent spacing for the larger carrier of FIG. 3. In the preferred embodiment the smaller carriers all have a first predetermined spacing, achieved for the various bottle sizes within the range of capability of the smaller carriers by varying the proportions of member 52 and other proportions of the carrier. All larger carriers have a larger second predetermined spacing similarly achieved. This is important to the operation of the invention for reasons which will be subsequently described (all smaller carriers could be given the same large second predetermined spacing of the larger carriers, though this was not done in the preferred embodiment.

Now referring to FIGS. 4 through 9, various aspects of the infeed worm drive system may be seen (the outfeed worm drive system is substantially identical and thus the description to follow applies to the outfeed system also). As may be seen in various figures, and particularly FIG. 5, infeed worm 60 is supported on a bearing assembly 62 above and at an acute angle with respect to the infeed conveyor assembly 20 so as to intercept bottles on the infeed conveyor and direct them to the carriers 64 on the rinser transport system. As may be best seen in FIG. 4, a bearing assembly 62 is mounted on a support assembly generally indicated by the numeral 64, supported by the frame of the rinser.

The worm 60 is driven through a drive system powered by the main rinser transport chain. In particular, the transport chain supporting sprocket drives sprocket 66, which in turn drives sprocket 68 through an appropriate chain. The shaft of sprocket 68 provides a drive through right angle drive 70 and a second right angle drive 72 to a transmission 74, which in turn drives worm 60 through sprockets 76 and 78 and associated chain. As may be seen in FIG. 4, sprocket 68 also drives sprocket 80 through a chain drive system, sprocket 80 providing power to the infeed conveyor system.

Figure 7:
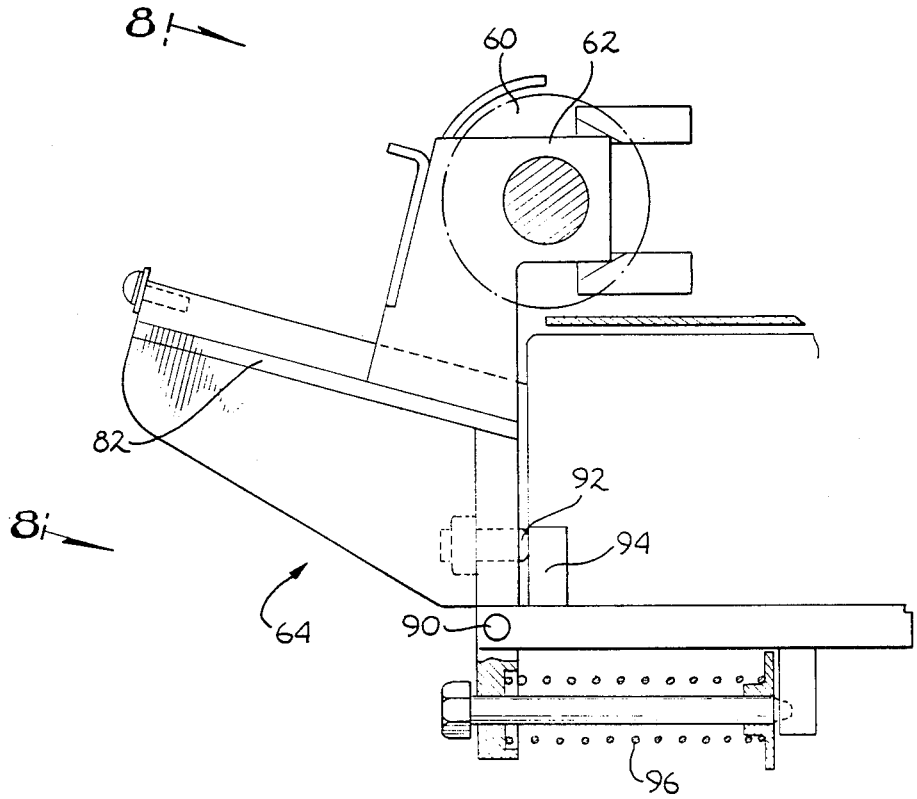
FIG. 7 is a view looking along the axis of the infeed worm illustrating the mounting thereof.
Figure 8:
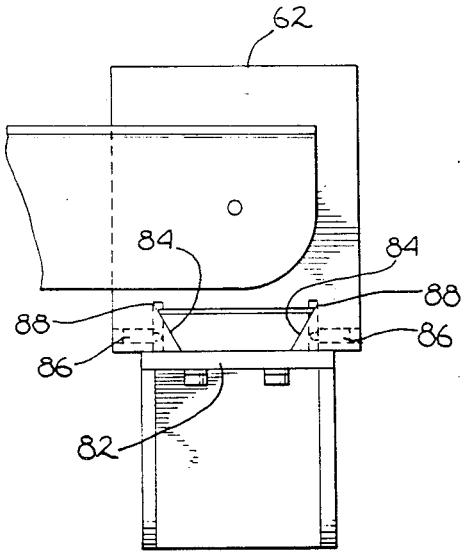
FIG. 8 is a view taken along line 8—8 of FIG. 7.

The support system 64 may be seen in better detail in FIGS. 7 and 8. In particular bearing assembly 62 mounts by way of the dovetail assembly of FIG. 8 to the support 82, the support being slideable along the dovetail assembly and lockable thereto by the inward deflection of part of the dovetail groove defining structure 84 by lockscrews 86 operating on dovetail walls 84, made somewhat flexible by longitudinal slots 88 in the bottom of the bearing assembly 62. Support 82 in turn is pivotally supported from the frame of the rinser by a pivot pin 90, the support being normally held in a predetermined position as a result of coil spring 96 forcing stop 92 on the support assembly against stop member 94 on the rinser frame. Normally the worms are positioned so as to entrap and guide the bottles without being forced flat against them, so that in normal operation the worm axis remains in a fixed position. If however, an obstruction occurs for any reason, the worm will be free to ride over the obstruction by deflecting outward against compression spring 96 to avoid damage to the worm or drive assembly.

When changing over for another bottle size, it is apparent from the structure just described with respect to FIGS. 7 and 8 that the position of the axis of the worm 60 may readily be adjusted as desired by loosening the dovetail assembly, sliding the bearing assembly in or out as desired and locking the assembly at the new position. In some instances, the worm itself will require changing, and for this purpose a quick change feature is included with the present invention. In particular, the worms 60 of the preferred embodiment are Delrin members mounted to a coaxial shaft 98 and locked thereto by pin 100. The outer end of shaft 98 is provided with a tapered region 102 for fitting within a cooperative taper in end 104 of the hollow spindle 106 of the bearing support assembly. Bolt 108 extending through the spindle is used to threadedly engage the tapered end 102 of shaft 98 in each worm to lock the worm in place, though provide a quick release therefor for changeover purposes. Cylindrical region 104 contains four reference marks, as does ring 105 which is locked to the worm. On first time setup the worm is adjusted in angle for the disired operation, after which the reference marks in ring 105 are aligned with the reference marks on region 104 and the ring permanently or semipermanently locked to the worm. Thereafter, the reference marks may be used for alignment purpose during changeover operations.

When changing from one smaller bottle size to a different small bottle size, or when changing from one larger bottle size to another large bottle size, worms 60 may or may not have to be changed, depending upon the differences in the bottle diameters. However, when changing from a smaller bottle size to a larger bottle size or vice versa, not only must the worms be changed, but also the worm drive speed must be changed. In particular, it is apparent from FIG. 5 that the pitch of each worm near the end adjacent the carriers on the main transport system should be such that the component of the pitch in the direction of movement in the transport system should equal the carrier spacing. Accordingly, since the carrier spacing for larger carriers is twice the carrier spacing of the smaller carriers (see FIGS. 2 and 3), the pitch of the ends of the worms adjacent the larger carriers will be twice the pitch of the corresponding portion of the worms for the smaller carriers (the worm inclination being the same in both instances). However, since the component of bottle velocity in the direction of the carrier motion must be the same as that of the carriers, the worms for the larger bottle sizes must be driven at half the rotational speed in relation to the main drive system as are the worms for the smaller carriers. Consequently, when changing over from larger bottle sizes to smaller bottle sizes, or vice versa, not only the worms but also the worm speeds must be shifted accordingly.

Figure 9:
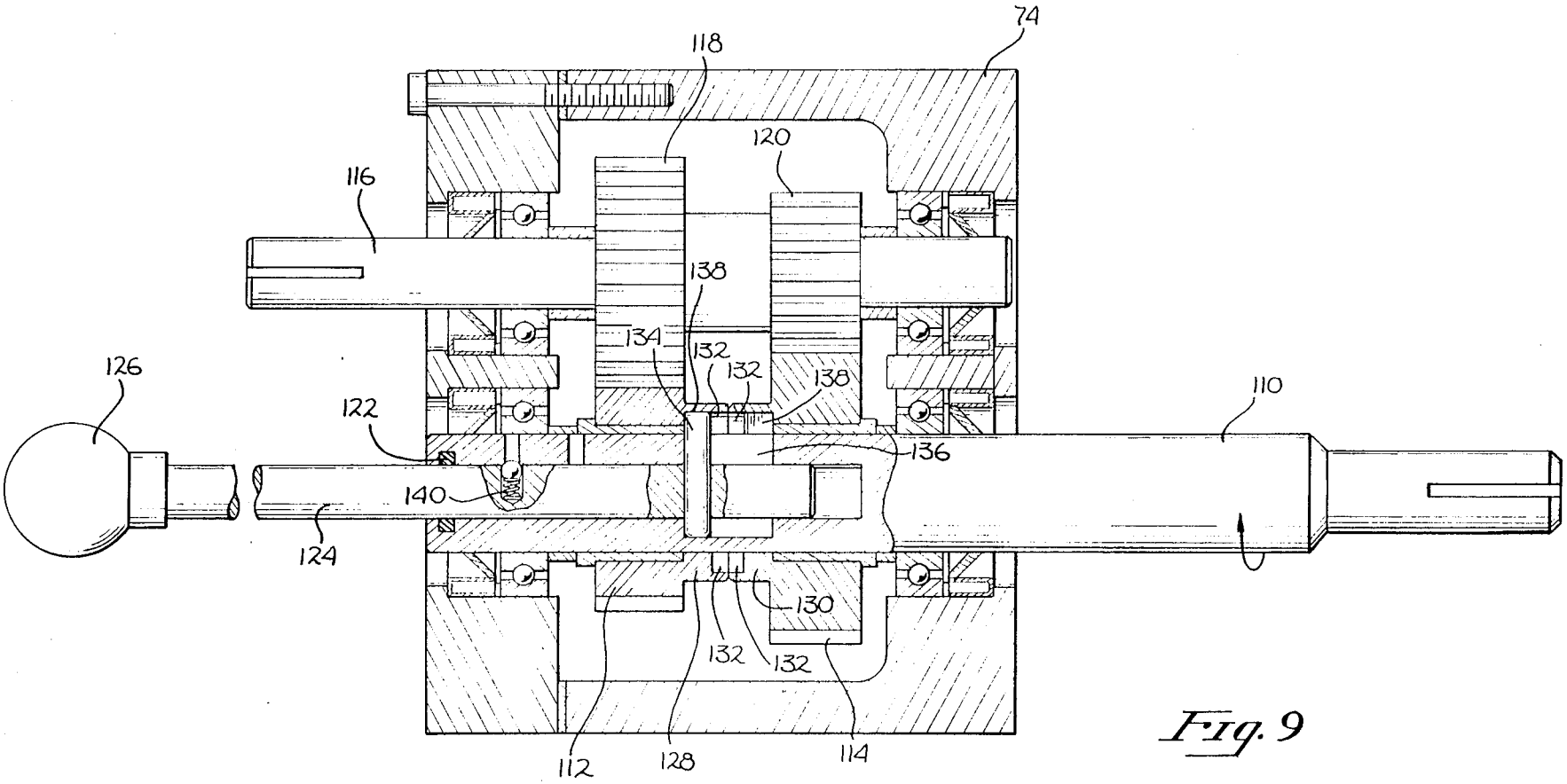
FIG. 9 is a cross section of the transmission 74 on FIG. 4.

The shifting of the worm speeds is done through transmission 74 (see FIG. 1), the details of which are shown in FIG. 9. In particular input shaft 110 supports a pair of gears 112 and 114 thereon within the transmission, gears 112 and 114 being freely rotatable with respect to the shaft 110. Output shaft 116 parallel to input shaft 110 has a pair of gears 118 and 120 directly coupled thereto. In the preferred embodiment, gears 112 and 118 each have 30 teeth, whereas gear 114 has 40 teeth and gear 120 has 20 teeth. Thus there is a one to one drive ratio between gears 112 and 118, and a one to two drive ratio between gears 114 and 120. The left end 122 of input shaft 110 has rod 124 positioned so as to be slidable therein through manual manipulation of shifting knob 126. Each of gears 112 and 114 has facingly disposed regions 128 and 130, respectively, with an annular bore 132 therein to provide clearance for pin 134 pressed through shaft 124 and passing through slot 136 in the input shaft 110. In addition to the annular regions 132, each of the gears 112 and 114 has a single slot 138 for receiving pin 134 in one and only one angular orientation of shaft 110 with respect to that gear, pin 134 being shown in slot 138 of gear 112 in FIG. 9. Thus with the shifting knob 126 in the position shown in the figure, gear 112 is locked to the input shaft 110 at a single predetermined angular orientation with respect thereto, providing a one to one drive through the transmission. When the shifting knob 126 is shifted to the right so that pin 134 is in slot 138 of gear 114, gear 114 will be locked to shaft 110 at a positive annular orientation with respect thereto to provide a drive ratio of one to two, thereby providing the shifting ratios required for the worm drives. A neutral is provided in the intermediate position by annular bores 132 which allow pin 134 to rotate with input shaft 110 without driving either gear, so that the transmission may be shifted out of one drive and dwell in neutral until pin 134 finds the drive slot in the other gear. A detent assembly, generally indicated by the numeral 140 is provided to provide a positive detent at either drive position.

Figure 10:
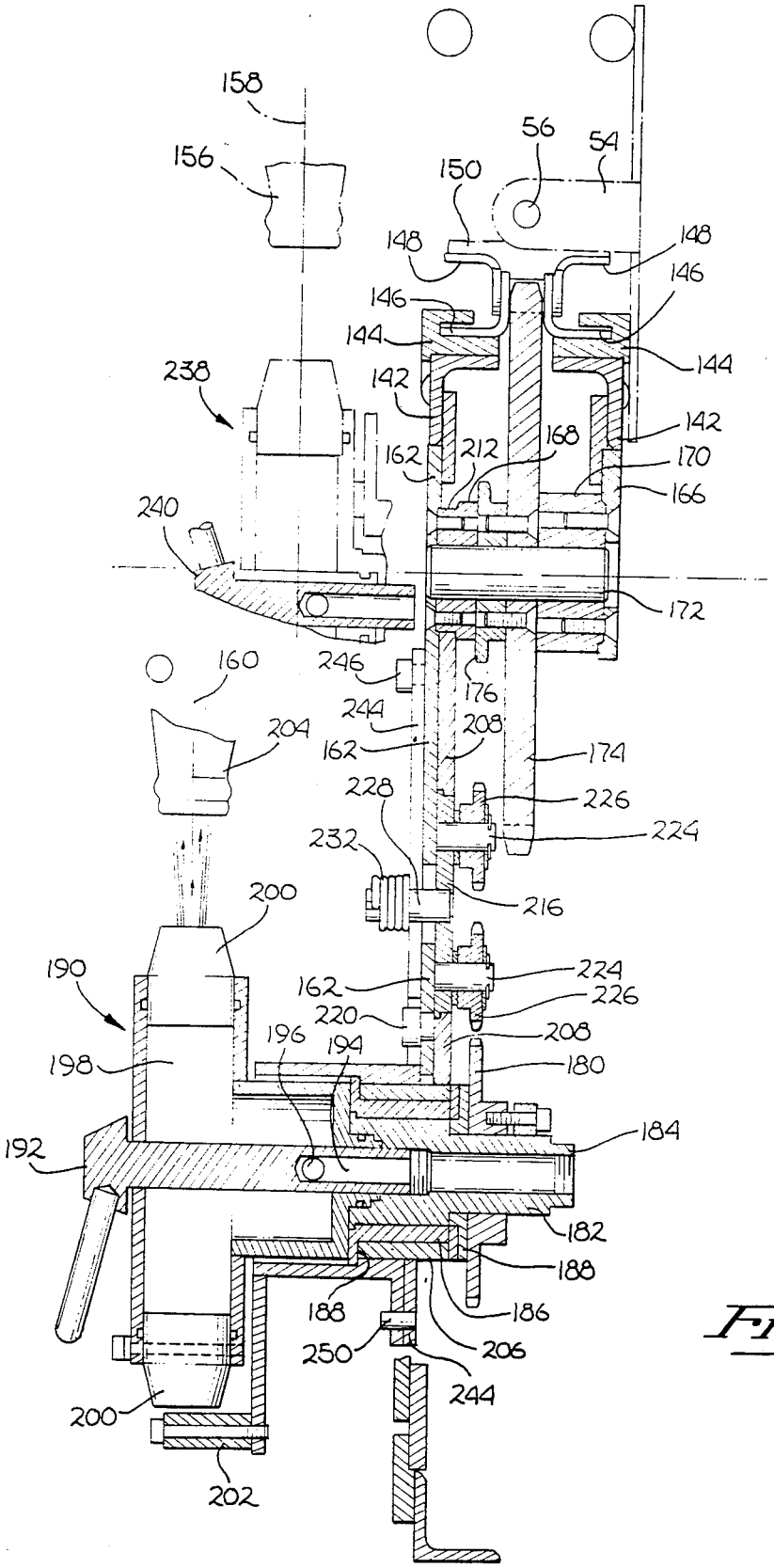
FIG. 10 is a cross section taken through a spray head assembly and drive and adjustment mechanism therefor.

Now referring to FIG. 10, a cross section of the transport system taken through one of the spray heads 32 (see FIG. 1) may be seen. The main rinser transport system is supported on a frame, with frame members 142 being visible in FIG. 10. Fastened to the frame members are guides 144 defining inwardly facing channels for receipt of the foot like regions 146 of the main transport chain. Alternate links of the chain have upward facing foot like regions 148 on which are mounted carrier mounting blocks 150, supporting each carrier by the carrier pivot pin 56. As previously mentioned, the elevation between the carrier pivot pin and the infeed and outfeed conveyors is fixed independent of the bottle size. Consequently, the top of a relatively short bottle will only extend slightly above pivot pin 56, so that when the carriers and bottles therein are inverted by guides 152 and 154 (see FIG. 1) the top of the bottle will be as indicated by the top 156 in FIG. 10. Obviously, the exact elevation of the top of the bottle in the inverted position will depend upon the height of the bottles being handled, though it should be noted, also as described before, that all size carriers of the smaller carrier size range are proportioned so that the center lines of the bottles held thereby are all equally spaced from the pivot pin 56, a condition which is obviously true whether the bottles are right side up or inverted. Accordingly, all of the smaller size bottles, regardless of the specific size of such bottles, will be oriented with their center line along line 158 of FIG. 10. All larger bottle sizes, on the other hand, as carried by any of the larger carrier sizes, will have their center lines aligned along line 160, the tops of the larger bottles in the inverted condition, of course, extending much lower than the smaller bottles because of the much greater height of the tops thereof. Thus in summary of the foregoing, the open tops of the smaller bottles, that is bottles of a size in the range which may be accommodated by a carrier on each carrier block 150 of the chain, will fall along center line 158, whereas the tops of the larger bottles, that is bottles of a size requiring a carrier on every other carrier, block will fall along line 160, the elevation of the tops of the smaller and larger bottles varying considerably along lines 158 and 160 respectively. Accordingly, it is apparent that in order for the spray of rinse water to be directed upward through the open top of each bottle as it passes, it is essential that the spray heads be adjustable in a manner which maintains coincidence of the spray with the open bottle tops. Accordingly, it is this aspect of the invention which is illustrated in detail in FIGS. 10 and 11.

Figure 11:
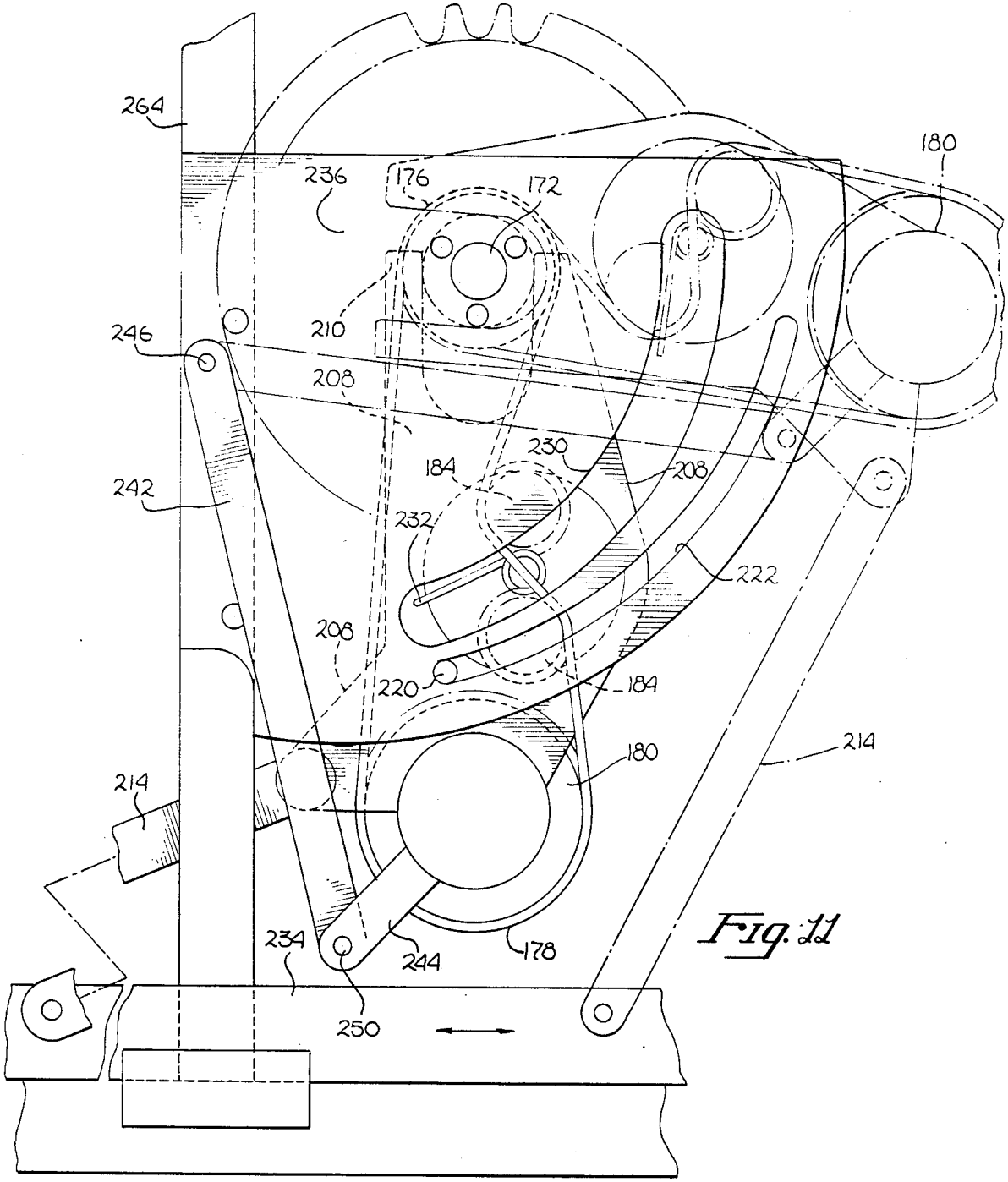
FIG. 11 is a side view of the spray head assembly drive and adjustment mechanism of FIG. 10.

At each spray head, mounted below frame members 142, is a sector plate 162 which is also mounted to the vertical frame members 164 (see FIG. 1) of the rinser frame. Mounted to the other frame member 142 (see FIG. 10 again) is a smaller plate 166, with the sector plate and the smaller plate 166 having members 168 and 170 fastened thereto, respectively, by screws, which together with bearing pin 172 provide a support for the assembly comprising larger sprocket 174 and smaller sprocket 176. The larger sprocket 174 extends upward so as to engage the chain and be driven in synchronism thereby, the smaller sprocket 176, of course, being driven by the larger sprocket 174. The smaller sprocket 176 drives a drive chain 178 (shown in FIG. 11, but omitted from FIG. 10 for purposes of clarity) which chain in turn drives sprocket 180. The slack or return side of the chain passes between sprockets 226 which are spring loaded in a manner about to be described to twist against the chain as shown in FIG. 11 to always maintain some chain tension. Sprocket 180 is fastened to hollow shaft assembly 182 having a fitting 184 on the right end thereof, as seen in FIG. 10, for receiving a rotatable coupling for connection to a supply of rinse water. The shaft assembly 182 rotates on a plastic journal bearing 186 and plastic thrust bearings 188. A spray head assembly generally indicated by the numeral 190 angularly indexes to the shaft assembly 182 by a locating pin, and is coupled to the shaft by bolt-like member 192 drilled longitudinally and crosswise to provide fluid communication through holes 194 and 196 between coupling 184 and internal region 198 of the rotating spray head assembly. The spray head assembly includes a plurality of equally spaced floating spray heads 200, the spray heads being forced by water pressure in region 198 toward their maximum radially extended position, though may be forced slightly inward by flow barrier 202 serving to effectively shut off the spray water flow in all heads not within plus or minus 30 degrees of top dead center.

The mechanism shown in FIG. 10 is shown with the spray head assembly 190 in its lowest position corresponding to the spray position for the largest, or more particularly the tallest bottles 204 of the larger bottle sizes. For this spacing, the sprocket sizes are selected and the rotation of the spray head is synchronized to the carriers on every other carrier link of the main drive chain so that when the bottle is directly over the spray head 190, one of the nozzles 200 is directed straight up into the bottle, and so that the spray head assembly 190 rotates at the proper speed so that the spray remains directed into the open bottle through the full 60 degree active arc (plus or minus 30 degrees from top dead center) of the spray nozzle. Obviously because the spray nozzle 200 is rotating with the spray head assembly rather than traveling linearly with the carriers, the spray will deviate somewhat from the center line of the bottle at the extremes of its active arc, though the deviation is slight and the spray remains directed into the open bottle throughout the full 60 degree active region of the spray nozzle.

It is apparent however, that if the bottle 204 was shorter so that the top thereof was higher, the spray from nozzle 200 would not properly track the bottle motion unless the spray head assembly 190 was raised accordingly. In particular, if the bottle opening was higher, nozzle 200 would properly direct a jet of water into the open bottle when the nozzle was at top dead center, but the jet would have a higher component of velocity along the transport system than the bottle itself would have, so that the jet would be properly directed into the bottle only over a small angular range about top dead center rather than over the desired plus or minus 30 degrees of top dead center. Thus one aspect of the present invention is the adjustability in height of the spray heads so that the distance between the axis of the spray head assembly 190 and the tops of the bottles may be maintained constant regardless of the bottle size being rinsed.

The adjustability of the spray head elevation in a manner so as to maintain the synchronism between the spray heads and bottles is provided as follows:

The bearing 186 for the shaft assembly 182 mounts within bearing housing member 206 which in turn is welded to yoke member 208 (and not the sector plate 162). The form of the yoke member 208 may be seen in FIG. 11. The yoke member is characterized by an upward extending yoke or forked like protrusions 210 which straddle so as to be slideable and rotatable with respect to diameter 212 (FIG. 10) on a thrust bearing member for sprocket 176. The yoke member 208, aside from supporting the bearing housing 206, also contains a protrusion coupling to linkage 214, an opening to encircle and entrap a circular plate 216, and a headed guide pin 220 for sliding in a circular arc 222 in the sector plate. Mounted to plate 216 is a pair of idler shafts 224 carrying idler sprockets 226, plate 216 also having a shaft 228 extending through a clearance slot 230 in the sector plate, with a spring 232 urging the plate 216 in rotation to cause the idler sprockets to maintain chain tension.

Yoke 208 is rotatable about the axis of pin 172 by a drive mechanism comprising linkage 214 coupled to a longitudinal slide bar 234 driven by a hand crank lead screw assembly so as to adjust the elevation of all spray heads in unison. In FIG. 11 the elevation of the axis of the spray head assembly, the chain take-up assembly and other elements such as the drive linkage 214 is also illustrated in phantom, showing the relative location thereof when the spray head assembly is in the highest elevation of the adjustment. During the adjustment, of course, the yoke is confined in motion by guide pin 220 in slot 222. It may be seen from FIG. 11 that the spray head assembly essentially swings in an arc for adjustment, and accordingly, effectively also laterally translates along the transport system as the elevation of the spray head assembly is changed. As a result, provision must be made to maintain synchronization of the nozzles with respect to bottles on the transport system. This is provided in part by the relative diameters of sprockets 176 and 180, in that proper selection of the ratio of diameters of these sprockets will cause a generally compensating rotation of the spray head assembly 190 throughout the adjustment range. This compensation however, in itself is not adequate in the preferred embodiment to maintain the desired accuracy in nozzle position. The desired final compensation or correction may be achieved by contouring slot 222 so that the yoke not only rotates about pin 172, but translates with respect thereto in a controlled manner during adjustment to maintain the desired synchronism. By way of example, it may be seen from the phantom representation of FIG. 11 showing sprocket 180 in its highest position, that if one translated the yoke slightly to the left toward pin 172, not only would the spray nozzles move in that direction relative to the transport system because of that lateral translation, but they would also move because of the sprocket effectively rolling around (rotating) on the drive side of the chain, the extra slack being taken up by the take up system hereinbefore described. Thus from the foregoing it may be seen that one can readily lay out the ideal contour for slot 222 by first rotating, but not translating, the yoke through some particular angular increment about the axis of pin 172, then translating the yoke radially with respect to the axis of pin 172 so that the spray head assembly rotates to realign the spray nozzles with the center line of the carriers on the transport system. Using this analysis technique, one need only be sure that the top dead center position of a spray nozzle for each yoke position is coincident with the center line of a carrier thereabove, as proper relative velocities of the carrier and spray nozzles will be assured by always adjusting the yoke to a position whereby the distance between the spray head assembly center line and the top of the bottles being rinsed is kept at the predetermined design value.

In laying out the contour of slots 222, one finds that the ideal slot contour is very close to a circular arc having a center at point 236. Accordingly, in the preferred embodiment of the invention, the contour of slot 222 is intentionally made to be a circular arc having a center at point 236, as the error in spray direction resulting from this approximation is not substantial in comparison to the deviation which may be tolerated. Finally, as commented on before, the center line 158 (see FIG. 10) of smaller bottles, that is any bottles on the smaller carriers on every carrier block is spaced outward from the center of pin 56 by a predetermined smaller spacing than the center line 160 of the larger bottles. Accordingly, the entire spray head assembly 190 may readily be removed by unscrewing mounting pin 192 and fastening a second spray head assembly 238 in its place by a shorter mounting screw 240, also angularly indexed with respect to shaft assembly 182.

During the adjustment of the elevation of the spray heads as just described, it is necessary that the shield 202 (FIG. 10) remain angularly oriented so that the spray nozzles remain active in approximately the same 60 degree arc centered around top dead center. This is achieved by the linkage comprised of arms 242 and 244. Arm 242 is pivoted by pivot pin 246 to frame member 164 of the rinser, and is pivoted at the other end to arm 244 by pivot pin 250 fastened to the arm 244. By making the distance and angle between the center of pivot pin 250 and the center of shaft assembly 182 approximately equal to the angle and distance between the center of pivot pin 246 and pin 172, an approximate parallelogram is formed whereby the shield 202 will translate without significant rotation during the spray head elevation adjustment. In that regard the shield 202 is matched to the spray head assembly and is removed therewith when the spray head assembly is removed for replacement by the other size spray head assembly and shield. Finally, since for the smaller carrier sizes, there will be a carrier and bottle on every carrier block link of the transport chain, whereas for the larger carrier sizes there will only be a carrier on every other carrier mounting block on the main transport chain, the spray head assembly 238 for the smaller carrier will have twice as many spray heads thereon as the spray head assembly 190 for the larger bottles.

Figure 13:
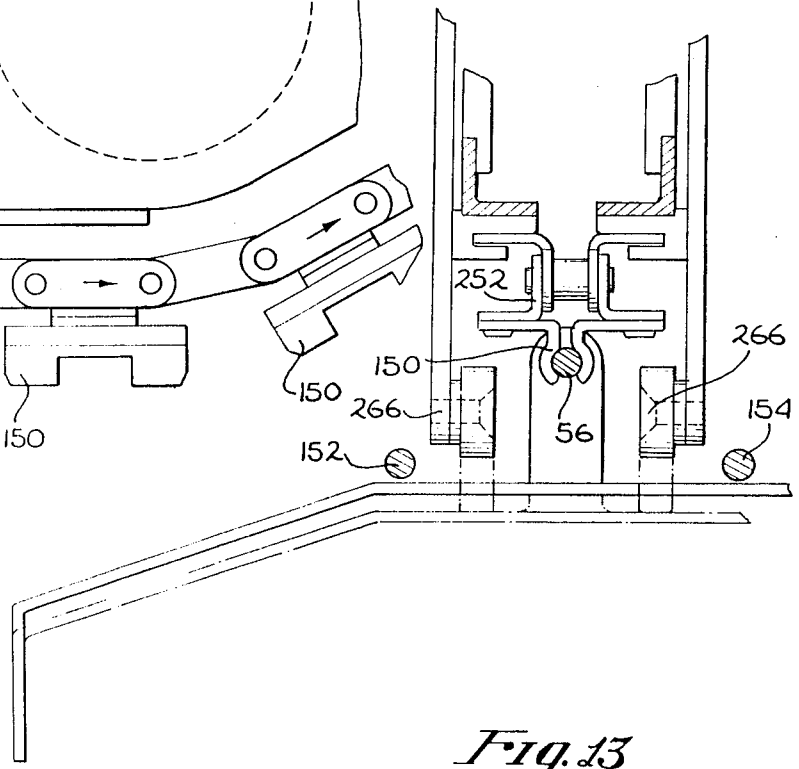
FIG. 13 is a partial cross section of the carrier stripping assembly of FIG. 12.
Figure 12:
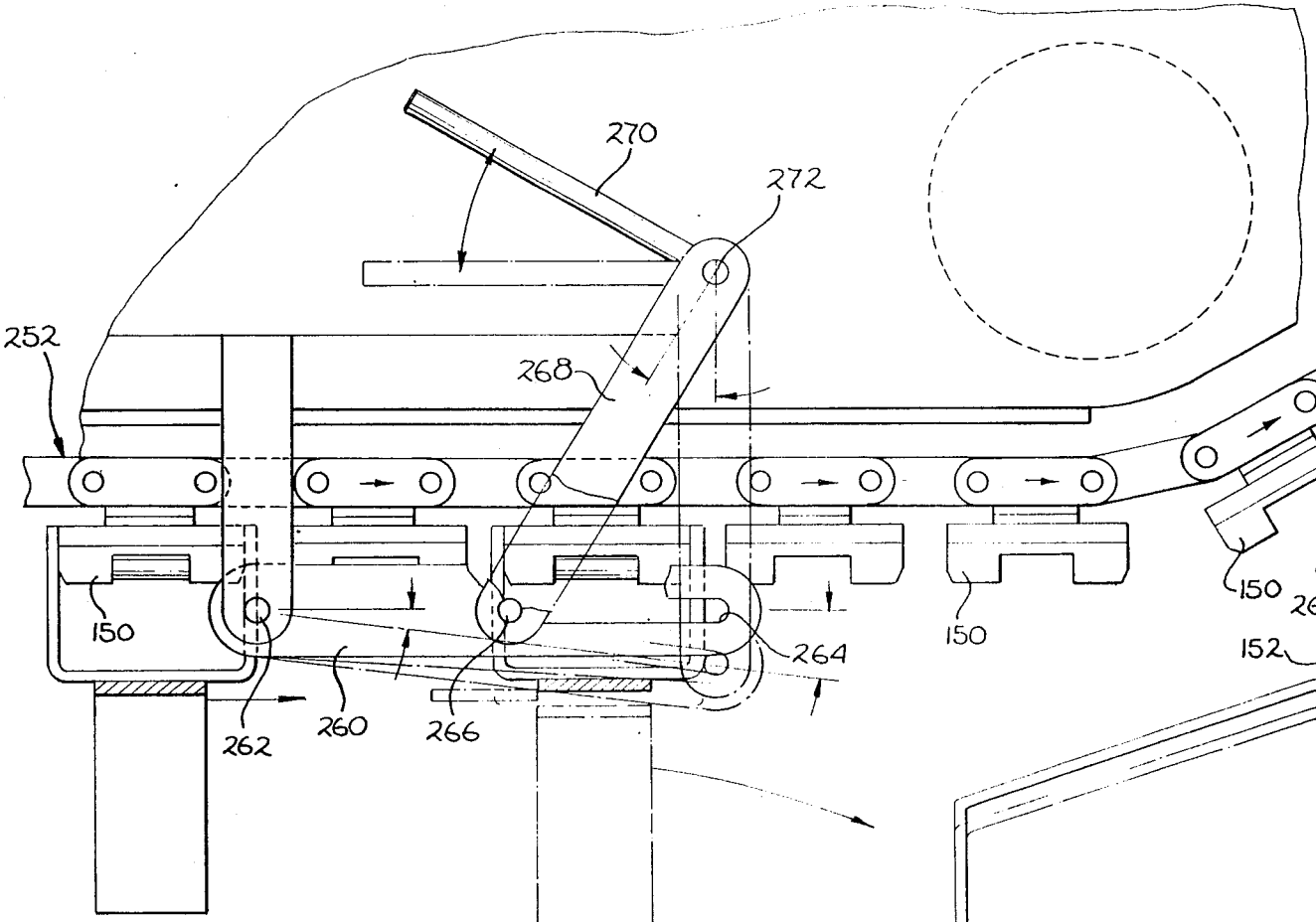
FIG. 12 is a side view of the carrier stripping assembly.

Now referring to FIGS. 12 and 13, the mechanism for automatic stripping carriers off of the transport system for carrier size changeover purposes may be seen. In particular, the main transport chain generally indicated by the numeral 252 has a carrier mounting block 150 on every other link of the chain into which a pin 56 of a carrier may be snapped or unsnapped. The particular carriers illustrated in FIGS. 12 and 13 are shown mounted on every other carrier block 150 and are therefore representative of the larger carriers of FIG. 3. The particular portion of the carrier chain shown in the preferred embodiment is a portion of the return just under the infeed end of the rinser. Throughout the return, the carriers are maintained in a basically horizontal orientation by the guides 152 and 154. A pair of stripper arms 260 are pivotally mounted to the frame by the rinser pins 262. The stripper arms have slots 264 therein, with pins 266 slideable within the slots 264 normally holding the stripper arms in an upper position through linkage comprised of arms 268 and actuating lever 270 pivoted about pivot 272. In this position, as may be seen in FIG. 13, the arms 260 are maintained in an upper position free and clear of the passing carriers. However, when lever 270 is depressed, stripper arms 260 are rotated downward so as to intercept carriers as they pass and strip them off of the main transport chain. In this manner, by running the machine slowly, the carriers on the machine may be automatically stripped off as a mechanic snaps carriers of another desired size onto the chain at the infeed end thereof.

There has been described herein an inline rinser suitable for use with bottles of substantially any popular size, which rinser has a fast changeover capability to change for operation with one bottle size to operation with another bottle size in a minimum of time. The system may be used to rinse the smaller bottles at higher bottle rates than larger bottles without requiring a speedup of the transport system as a result of being able to accommodate twice the number of carriers for smaller bottle sizes. Also different spray head assemblies may be supplied from different water sources, which might represent different levels of purity or different water temperatures. As an example of the latter, the water for the spring head assembly closest to the infeed section may be elevated somewhat above ambient, the temperature of the water for the next spray head assembly elevated still more, etc. (even eventually going to steam, if desired), whereby a hot water or steam rinse and/or sterilization will be achieved without undue thermal shock to the glass of the container, and without risk of cracking or chipping as a result thereof. In that regard, the system of the present invention may be used to progressively heat containers prior to the hot filling of the containers without undue thermal shock thereto in instances where the hot filling itself or a single hot rinse would risk cracking or chipping of the container. Obviously, while the preferred embodiment of the invention has been disclosed and described in detail herein, it will be obvious to those skilled in the art that various changes in form and detail may be made therein without departing from the spirit of the invention.

I claim:

1. An inline bottle rinser comprising;

a transport system having a continuous chain defining a transport path having an infeed end, an outfeed end and a rinse region therebetween, said transport system defining a substantially straight path through said rinse region, said chain having a plurality of equally spaced carrier mounting means thereon, each for receiving and supporting a bottle carrier;

a transport system drive means for driving said continuous chain along said transport path;

a plurality of equally spaced first bottle carriers, each for receiving and supporting a bottle therein, each said first bottle carrier being rotatably coupled to one of said carrier mounting means for rotation between bottle upright and bottle inverted positions;

bottle carrier guide means for guiding said first bottle carriers to a bottle upright orientation at the said infeed end of said transport path, a bottle inverted orientation in said rinse region and back to a bottle upright orientation at said outfeed end;

infeed means for feeding bottles into said first bottle carriers at said infeed end;

outfeed means for removing bottles from said first bottle carriers at said outfeed end;

a rotating spray head assembly, said spray head assembly being disposed below said rinse region for rotation as a unitary assembly about the central horizontal axis thereof, and having a plurality of spray heads thereon, each for directing a stream of water substantially radially from said central axis into an inverted bottle spaced from and passing thereabove, whereby a stream of water is directed into each inverted bottle passing thereby;

chain drive means coupled between said transport system and said spray head assembly for driving said spray head assembly from said transport system at a speed proportional to the speed of said transport system, said chain drive means including a first sprocket associated with said transport system and rotating therewith about a horizontal axis, a second sprocket coupled to said spray head assembly, and a drive chain encircling said first and second sprockets, whereby said first sprocket will tension the drive side of the chain between said first and second sprockets to cause rotation of said second sprocket therewith;

adjustment means for adjusting the elevation of said rotating spray head assembly with respect to said transport system, said adjustment means including support means for supporting said spray head assembly to provide controllable movement of said spray head assembly in an arc in a vertical plane, including synchronizing means for varying the drive side length of the chain between said first and second sprockets as said spray head assembly is moved for maintaining synchronization between said spray head assembly rotation and said first bottle carrier movement with respect thereto, whereby elevational adjustments, to allow rinsing bottles of a different height, may be made for said rotating spray head assembly dependent upon the elevation of the openings in the bottles in the rinse region and still continue to direct a stream of water into each inverted bottle passing thereby.

2. The rinser of claim 1 wherein each said spray head will direct a stream of water into each inverted bottle passing thereby over a substantial angle of rotation of said rotating spray head means.

3. The rinser of claim 2 wherein said substantial angle is approximately 60 degrees.

4. The rinser of claim 1 wherein said first bottle carriers are removable from said carrier mounting means and replaceable with second bottle carriers proportioned to receive and support bottles of another size.

5. The rinser of claim 4 wherein said first and second carriers and said carrier mounting means are adapted for the quick removal and replacement of carriers.

6. The rinser of claim 5 further comprised of manually controllable means for automatically removing carriers from said carrier means.

7. The rinser of claim 4 wherein said first and second carriers are proportioned to receive bottles of different heights, said first and second carriers each being rotatably coupleable to one of said carrier mounting means about an axis having a predetermined elevation with respect to the portion of each said carrier receiving the bottom of a bottle therein, whereby the elevation of the top of bottles of one height in said first carriers will be different both in the upright and inverted orientations than the top of bottles of another height in said second carriers.

8. The rinser of claim 7 wherein said adjustment means is a means for adjusting the elevation of said rotating spray head assembly so that the relative elevations of the tops of bottles in said first carriers when in the inverted orientation and the axis of rotation of said spray head assembly, and of other bottles of another height in said second carriers when in the inverted orientation and the axis of rotation of said spray head assembly, may be adjusted to a fixed predetermined relative elevation.

9. The rinser of claim 4 wherein said infeed and outfeed means each includes a worm means having a worm member driven in rotation in synchronism with said transport system, said worm means at said infeed end being a means for receiving bottles from an infeed conveyor and directing them into carriers on said transport system, and said worm means at said outfeed end being a means for receiving bottles from carriers on said transport system and delivering them to an outfeed conveyor, and wherein said worm means are adapted for quick change of said worm members for different bottle sizes.

10. The rinser of claim 9 wherein said first and second bottle carriers are proportioned to have the same predetermined lateral spacing between the axis of rotation of each said bottle carrier on the respective carrier mounting means and the centerline of a botte received and supported thereby.

11. The rinser of claim 10 wherein said second bottle carriers are rotatably coupleable to the same said carrier mounting means as said first bottle carriers.

12. The rinser of claim 9 wherein said worm members are each cantilevered from one end thereof on a supporting bearing assembly so as to be easily removed therefrom.

13. The rinser of claim 4 wherein said second bottle carriers are larger and rotatably coupleable to every other said carrier mounting means in comparison to said first bottle carriers.

14. The rinser of claim 13 wherein said infeed and outfeed means each includes a worm means having a worm member driven in rotation in synchronism with said transport system, said worm means at said infeed end being a means for receiving bottles from an infeed conveyor and directing them into carriers on said transport system, and said worm means at said outfeed end being a means for receiving bottles from carriers on said transport system and delivering them to an outfeed conveyor, and wherein said worm means are adapted for quick change of said worm members for different bottle sizes, said worm means further including speed shifting means to change the speed of rotation of each said worm members by a factor of two while maintaining synchronism in the rotation of said worm member with said transport means.

15. The rinser of claim 14 wherein said worm members are each cantilevered from one end thereof on a supporting bearing assembly so as to be easily removed therefrom.

16. The rinser of claim 13 wherein said rotating spray head assembly is removable and replaceable with a second spray assembly having one half the number of spray heads thereon for use with said second bottle carriers.

17. The rinser of claim 1 further including a plurality of rotating spray head assemblies disposed along said transport path, the first said spray head assembly being supplied with water of a first elevated temperature, and each successive said spray head assembly being supplied with water elevated in temperature with respect to the water supplied to the preceeding spray head assembly, whereby a bottle proceeding through said rinser will be progessively heated.

18. An inline bottle rinser comprising;

a transport system having a continuous chain defining a transport path having an infeed end, an outfeed end and a rinse region therebetween, said transport system defining a substantially straight path through said rinse region, said chain having a plurality of equally spaced carrier mounting means thereon, each for receiving and supporting a bottle carrier;

a plurality of equally spaced first bottle carriers, each for receiving and supporting a bottle therein, each said first bottle carrier being rotatably coupled to one of said carrier mounting means for rotation between bottle upright and bottle inverted positions, said first bottle carriers being removable from said carrier mounting means and replaceable with second bottle carriers proportioned to receive and support bottles of another size;

bottle carrier guide means for guiding said first bottle carriers to a bottle upright orientation at the said infeed end of said transport path, a bottle inverted orientation in said rinse region and back to a bottle upright orientation at said outfeed end;

infeed means for feeding bottles into said first bottle carriers at said infeed end;

outfeed means for removing bottles from said first bottle carriers at said outfeed end said infeed and outfeed means each including a worm means having a worm member driven in rotation in synchronism with said transport system, said worm means at said infeed end means for receiving bottles from an infeed conveyor and directing them into carriers on said transport system, and said wrom means at said outfeed end being a means for receiving bottles from carriers on said transport system and delivering them to an outfeed conveyor, said worm means being supported only at one end thereof on a supporting bearing and adapted for quick change of said worm members for different bottle sizes;

a rotating spray head assembly, said spray head assembly being disposed below said rinse region and having a plurality of spray heads thereon, each for directing a stream of water into an inverted bottle passing thereby, whereby a stream of water is directed into each inverted bottle passing thereby;

drive means for driving said spray head means at a speed proportional to the speed of said transport system;

adjustment means for adjusting the elevation of said rotating spray head assembly with respect to said transport system, including synchronizing means for maintaining synchronization between said spray head assembly rotation and said first bottle carrier movement with respect thereto, whereby elevational adjustments, to allow rinsing bottles of a different height, may be made for said rotating spray head assembly dependent upon the elevation of the openings in the bottles in the rinse region nd still continue to direct a stream of water into each inverted bottle passing thereby.

19. An inline bottle rinser comprising;

a transport system having a continuous chain defining a transport path having an infeed end, an outfeed end and a rinse region therebetween, said transport system defining a substantially straight path through said rinse region, said chain having a plurality of equally spaced carrier mounting means thereon, each for receiving and supporting a bottle carrier;

a plurality of equally spaced first bottle carriers, each for receiving and supporting a bottle therein, each said first bottle carrier being rotatably coupled to one of said carrier mounting means for rotation between bottle upright and bottle inverted positions, said first bottle carriers are removable from said carrier mounting means and replaceable with second bottle carriers proportioned to receive and support bottles of another size, said second bottle carriers being larger and rotatably coupleable to every other said carrier mounting means in comparison to said first bottle carriers;

bottle carrier guide means for guiding said first bottle carriers to a bottle upright orientation at the said infeed end of said transport path, a bottle inverted orientation in said rinse region and back to a bottle upright orientation at said outfeed end;

infeed means for feeding bottles into said first bottle carriers at said infeed end;

outfeed means for removing bottles from said first bottle carriers at said outfeed end, said infeed and outfeed means each including a worm means having a worm member driven in rotation in synchronism with said transport system, said worm means at said infeed end being a means for receiving bottles from an infeed conveyor and directing them into carriers on said transport system, and said worm means at said outfeed end being a means for receiving bottles from carriers on said transport system and delivering them to an outfeed conveyor, and wherein said worm means supported from one end only on a supporting bearing assembly so as to be cantilevered therefrom, and are adapted for quick change of said worm members for different bottle sizes, said worm means further including speed shifting means to change the speed of rotation of each said worm members by a factor of two while maintaining synchronism in the rotation of said worm member with said transportation means;

rotating spray head assembly, said spray head assembly being disposed below said rinse region and having a plurality of spray heads thereon, each for directing a stream of water into each an inverted bottle passing thereby, whereby a stream of water is directed into each inverted bottle passing thereby;

drive means for driving said spray head means at a speed proportional to the speed of said transport system;

adjustment means for adjusting the elevation of said rotating spray head assembly with respect to said transport system, including synchronizing means for maintaining synchronization between said spray head assembly rotation and said first bottle carrier movement with respect thereto, whereby elevational adjustments, to allow rinsing bottles of a different height, may be made for said rotating spray head assembly dependent upon the elevation of the openings in the bottles in the rinse region and still continue to direct a stream of water into each inverted bottle passing thereby.

* * * * *